United States Patent [19]

Taylor et al.

[11] 4,124,971

[45] Nov. 14, 1978

[54] CABLE WINDING APPARATUS AND METHOD

[75] Inventors: Edwin K. Taylor; James H. Williams, both of Bristow; Fred Kobos, Tulsa, all of Okla.

[73] Assignee: Arch Manufacturing Company, Tulsa, Okla.

[21] Appl. No.: 779,597

[22] Filed: Mar. 21, 1977

[51] Int. Cl.[2] ..... D07B 1/12; D07B 7/00

[52] U.S. Cl. ..... 57/9; 57/11; 57/33; 57/311

[58] Field of Search ..... 57/3, 6, 9, 11, 13, 57/15, 33, 39, 40, 1 R, 34 R, 138, 156, 160, 166

[56] References Cited

U.S. PATENT DOCUMENTS

| | | | |
|---|---|---|---|
| 1,772,191 | 8/1930 | Morin | 57/15 |
| 2,811,010 | 10/1957 | Balint | 57/9 |
| 3,020,701 | 2/1962 | McCormick | 57/15 X |
| 3,037,343 | 6/1962 | Haas et al. | 57/11 X |
| 3,187,494 | 6/1965 | Fuller | 57/9 |
| 3,234,721 | 2/1966 | Carter | 57/9 X |
| 3,236,039 | 2/1966 | Fletcher et al. | 57/9 X |
| 3,446,001 | 5/1969 | Akachi | 57/138 |
| 3,641,755 | 2/1972 | Heinen et al. | 57/9 |
| 3,811,257 | 5/1974 | Burr | 57/9 |
| 3,896,860 | 7/1975 | Iannucci | 57/9 X |
| 3,983,912 | 10/1976 | Iannucci | 57/9 X |

*Primary Examiner*—Donald Watkins

*Attorney, Agent, or Firm*—Head, Johnson & Chafin

[57] ABSTRACT

Apparatus and method for manufacturing a wire wound flexible torque transmission cable. The apparatus includes multiple wire guides to facilitate the winding of a plurality of preformed spring or wire coil members onto a mandrel or a previously wrapped layer. The apparatus further includes a means for synchronously moving the wrapped mandrel longitudinally and rotatingly with respect to the wire guide for accomplishing the winding process. The cable winding process generally includes the steps of winding a plurality of wires to form a single layer, each wire being in the form of a preformed cylindrical helical coil stock. Multiple layers of wire are similarly wound on the next previous layer, the windings normally being in a reverse direction from the next previous layer.

22 Claims, 10 Drawing Figures

CABLE WINDING APPARATUS AND METHOD

BACKGROUND OF THE INVENTION

1. Field of the Invention

The present invention relates to method and means for manufacturing wire cable for torque transmission application and more particularly but not by way of limitation to a method and means for producing cable using preformed spring stock for the wrappings.

2. History of the Prior Art

There is widespread use of wire wound torque transmission cables where it is desirable to induce rotary motion at a remote location from the rotary power source. Normally, such cables are manufactured by various processes and apparatus which wrap a plurality of wires onto either a solid or hollow flexible mandrel. If it is desired that the finished product be a solid torque transmitting cable, the mandrel is usually flexible and becomes a part of the finished cable.

On the other hand, if the torque transmitting cable is to be hollow, the mandrel must either be removed after the winding process or the mandrel must be flexible and also hollow.

After the wrapping process about a mandrel is done, it is extremely difficult to remove the mandrel from the finished product. Further there is a tendency for the wire after it has been wrapped to spring open if either end is released.

Heretofore, the general method of removing the mandrel is to allow the winding to spring open to a certain extent. While this allows easy removal of the mandrel, it changes the size of the finished torque transmission cable which gives rise to obvious quality control problems in both sizes. Another problem associated with such cables is that of internal stress present between successive layers of windings which tend to decrease the efficiency of torque transmission and the life of the cable. There has also been a problem associated with the winding of very small wire by the prior art methods.

SUMMARY OF THE INVENTION

The present invention is particularly designed and constructed to produce a wire wound torque transmitting cable for overcoming the above disadvantages associated with prior art cable winding process and means.

The present invention comprises a process for manufacturing a torque transmitting cable having a plurality of oppositely wound layers of wire, each layer consisting of a plurality of individual wire windings. The process includes a first step of forming a spring or using stock spring and dispensing that spring onto a relatively smooth mandrel. By forming the spring at the production site, it may be applied to the mandrel directly out of the spring winding machine. A plurality of springs may be utilized for the first layer by setting the pitch with respect to the diameter of the wire from which the coils are made such that the layer is substantially uniform. The inner diameter of the springs making up the first layer is such that the mandrel provides support for the springs but may be longitudinally removed therefrom.

The second layer of windings is applied utilizing a spring or coil guide device which comprises a plurality of elongated tube members which are parallel with respect to each other but arranged in a circular pattern such as the barrels of a Gatling gun, each of the tubes being capable of carrying a preformed coil which will become a second layer of the torque transmission cable. This second set of $N_2$ coils are wound in the opposite direction from the first set. The inner diameter of each of the second springs is substantially equal to the outer diameter of the first set of springs.

The coil guide device further includes a centrally disposed tube for loosely carrying the mandrel having the first layer of wire disposed thereon.

The coil guide device has, at one end thereof, a coil feed head which has a plurality of channels or passages for directing the coil ends centrally toward the center tube and the wound mandrel therein.

The secured coil ends are then manually attached to the first layer of winding adjacent one end of the mandrel. The mandrel is then rotated and simultaneously withdrawn from the center tube thereby snuggly wrapping the second layer of coils onto the first layer.

If it is desirable to add successive layers, each successive layer is added by repeating the second step. It is desirable that each successive layer be made up of coils wound in the opposite direction from the next previous layer.

When the cable is finished, the mandrel is slipped out of the cable and is reusuable provided a hollow cable is desired. The ends are usually further stress relieved by striking against a surface and are then trimmed to the desired length. The ends of the finished cable are then usually tinned and attached to a desired fitting.

The finished cable has little or no internal forces associated therewith as with prior art cables. The reason for the lack of internal or binding forces between layers is that each layer of the present process is finished and the cable removed from the winding fixture, both ends are free to relax thereby relieving any winding stresses. It is further apparent that the cable sizing may be accurately maintained by the proper manufacture of the individual coils and is therefore not so dependent on the tightness of the wrappings. Since by the present method, size and quality may be strictly maintained, cables having various desired design characteristics may be readily manufactured under the present process.

BRIEF DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 4:
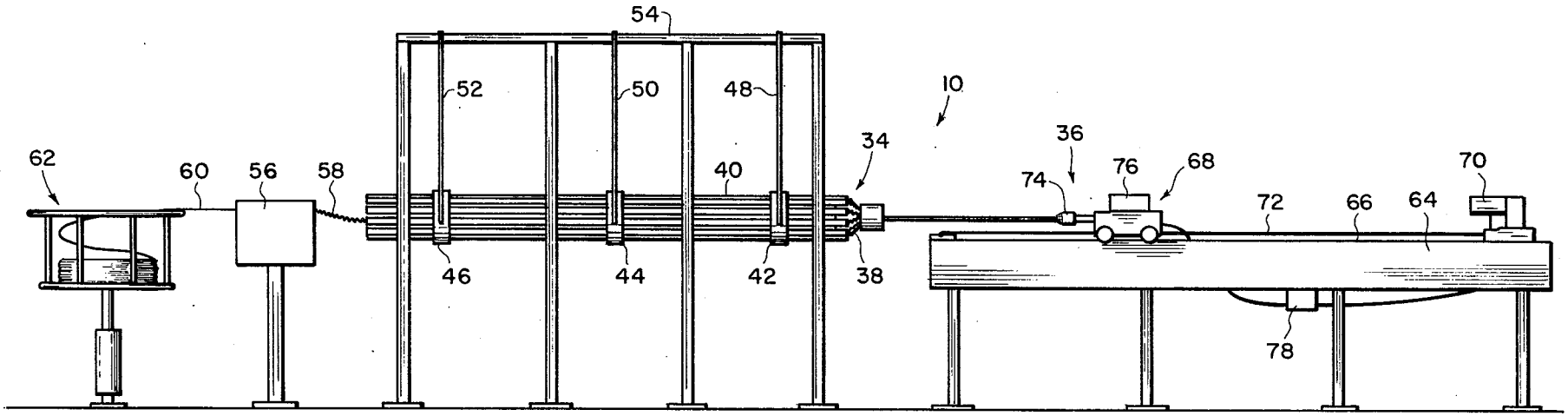
FIG. 4 is an elevational view of a wire winding apparatus for winding subsequent layers of wrap.
Figure 5:
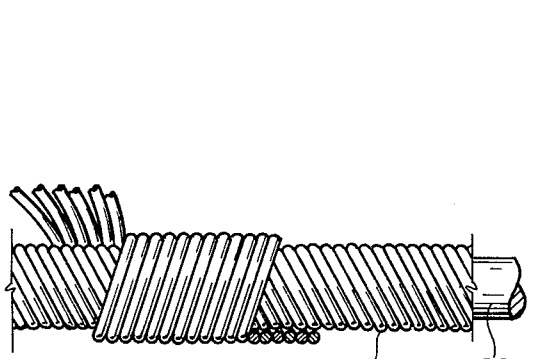
FIG. 5 is an elevational view depicting a second or subsequent layer of winding along with a size comparison.

Referring to the drawings in detail reference character 10 generally indicates a wire winding apparatus for the manufacture of flexible torque transmission cable. The cable may comprise several layers of wire wrapping as will be hereinafter set forth, and each layer may be wound by a separate apparatus of which 10 is typical.

Figure 1:
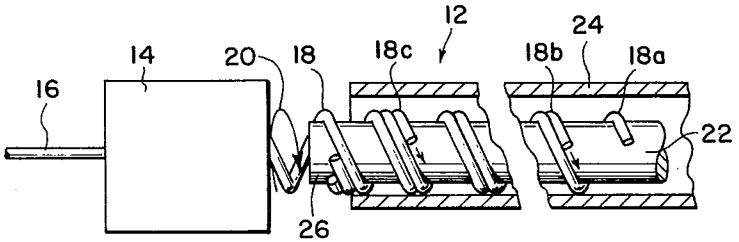
FIG. 1 is an elevational view of a mandrel being wound with a first wire layer.

Referring now to FIG. 1 reference character 12 generally indicates an alternate wrapping apparatus and procedure that has been found useful for wrapping the first layer of the cable. An ordinary spring or coil forming device 14 is utilized to receive at its input wire stock 16 to form said wire stock 16 into a helical coil 18 at its output. As a characteristic of the output coil 18, there is a rotation of the coil that is indicated by the rotational vector 20.

As a temporary support apparatus for the cable being constructed, an elongated mandrel 22 is loosely disposed within a hollow tube 24, all in alignment with the output of the coil forming device 14. The mandrel 22 may be a metal rod having an outer diameter which is substantially equal to the desired inner diameter of the final cable being produced. However, the first layer should not be tightly wound since the mandrel may be subsequently removed.

Figure 3:
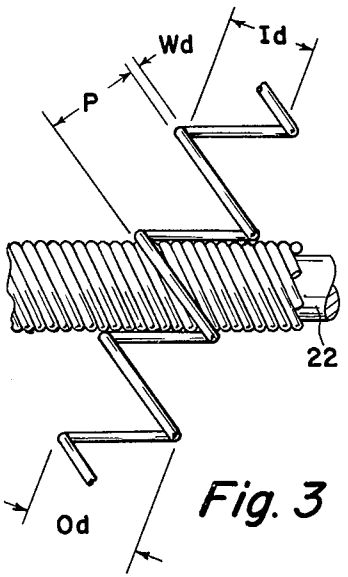
FIG. 3 is a diagrammatical view of a typical spring coil.

Referring now to FIG. 3, each individual coil of wire for each layer has certain characteristics which is set by adjusting a coil forming apparatus such as 14. The coil produced is a cylindrical helical coil having an inside diameter (I*d*) which is substantially equal to the diameter of the mandrel 22 or the previous layer. The outside diameter (O*d*) is naturally equal to the inside diameter plus two times the wire diameter (W*d*). The pitch (P) of the coil 18 or subsequent coil is set in accordance with the number (N) of the desired coils to form the particular first layer. Therefore, if it is desired to have N coils to make up a particular layer, the pitch is set by the coil forming apparatus such as 14 to be approximately equal to or slightly greater than N times the wire diameter (W*d*), or by the equation $P \geqq NWd$.

Naturally, if it is desired to use a single wire to wrap the first layer, N would be equal to one and the pitch would be approximated by the diameter of the wire (W*d*) being used.

Tests and actual manufacturing have revealed that there is a practical limit on (N) for a given wire diameter and stiffness. For instance in the first layer of wire where the wire diameter W*d* is 0.018 inches, it has been found that N should not exceed 4. It has further been found that as the wires are threaded on the first layer in the manner hereinafter set forth that the driver end of the wire tends to expand slightly due to greater driving torque as the entire length of the wire is threaded on the mandrel. However, it has been found that for manufacturing purposes a 0.002 inch difference between the two ends is acceptable.

Figure 2:
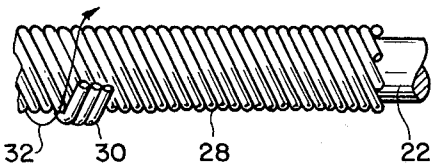
FIG. 2 is an elevational view of a mandrel segment supporting a first wrapped layer.

Utilizing the apparatus as schematically depicted in FIG. 1, a first wire coil 18*a* is started on the end 26 of the mandrel 22 and is allowed to rotatingly feed directly out of the coil forming apparatus 14 onto the mandrel 22 being contained loosely in the tube 24. After the coil 18A is in place, a second coil 18B is fed onto the end 26 of the mandrel 22, wherein it will rotatingly move onto the mandrel 22 as shown in FIG. 1. The wire coil 18C is then added in the same manner and each subsequent coil is added until the desired number (N) of the coils are moved onto the mandrel 22 which will appear as shown in FIG. 2 thereby forming a single layer 28 on the mandrel. The layer 28 will obviously have an outer diameter (O*d*) equal to the outer diameter of each of the coils taking up the layer.

A second or subsequent layer 30 may be added on top of the layer 28. However, each individual coil making up the layer 30 could be wound in the opposite direction from the coils 18 and should be wound in the opposite direction if torque transmission is desired in either direction, as indicated by the rotational vector 32. If wrappings are for a subsequent layer are to be made in the same directions, their pitch should be significantly different than the previous layer so that the wires do not try to work themselves in between the wires of the previous layer. Each of the coils making up the layer 30 would naturally have an inside diameter substantially equal to the outside diameter of the previous layer. The pitch of each such coil would be calculated by the aforementioned equation or should be such that the pitch is substantially equal to or greater than the inside diameter.

Referring now to FIG. 4, the winding apparatus 10 comprises a coil guide means generally indicated by reference character 34 and a winding apparatus 36.

The coil guide means 34 generally comprises a coil guide feed head 38 having one end of each of a plurality of elongated parallel tube members 40, said tube members being arranged circumferentially around the coil guide head 38. The plurality of tubes 40 are held in spaced relationship by a number of mounting plates 42, 44 and 46. Then each of these mounting plates is suspended by hanger means 48, 50 and 52 respectively from a framework 54.

A coil forming apparatus 56 is shown in FIG. 4 and is substantially identical to the coil forming apparatus 14 of FIG. 1. The coil forming apparatus 56 may be one of several used to feed coiled wire 58 into each of the tubes 40. Each coil forming apparatus receives its wire stock 60 from a wire dispensing spool apparatus generally indicated by reference character 62. It might be desirable to have a coil forming apparatus such as 56 for feeding each of the tubes 40 simultaneouly. Naturally, coil stock may be purchased separately and fed into the tubes since the coil forming operating is not an essential part of the winding apparatus 10.

The winding apparatus 36 generally comprises a platform means 64 having an upper track surface 66 which is substantially parallel to the tube bundle 40 of the coil guide means 34. A trolley apparatus generally indicated by reference character 68 is reciprocally disposed on the track surface 66 and is provided with a drive motor 70 and connecting drive chain 72.

The trolley apparatus 68 comprises a mandrel gripping chuck 74 which may be rotationally driven by a separate drive motor 76 carried by the trolley 68. The chuck 74 is positioned to be in substantially coaxial alignment with the coil guide feed head 38 for a purpose that will be hereinafter set forth. The winding apparatus 36 further comprises a synchronization device 76 which is operably connected between the trolley drive motor 70 and the chuck drive motor 76 so that the longitudinal movement of the trolley must be synchronized with the rotational movement of the chuck 74 for a purpose that will hereinafter be set forth.

Figure 7:
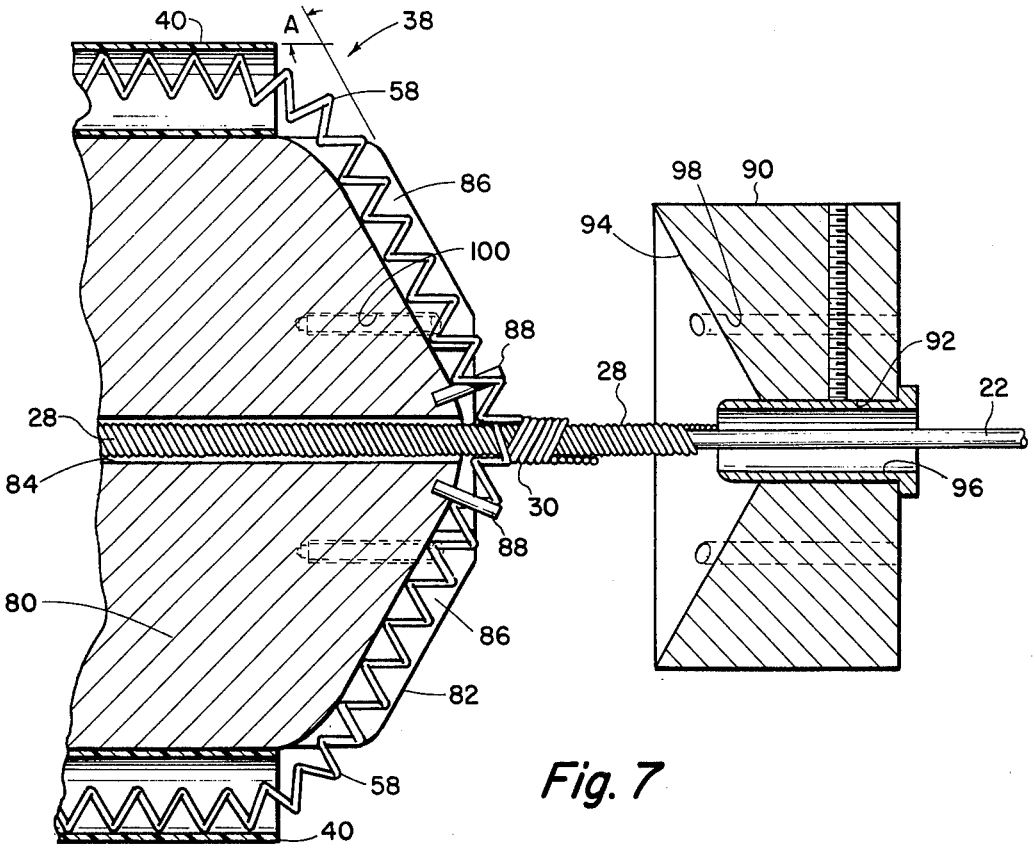
FIG. 7 is a partial sectional view of the wire feed head and cap preparatory to a subsequent winding operation.
Figure 8:
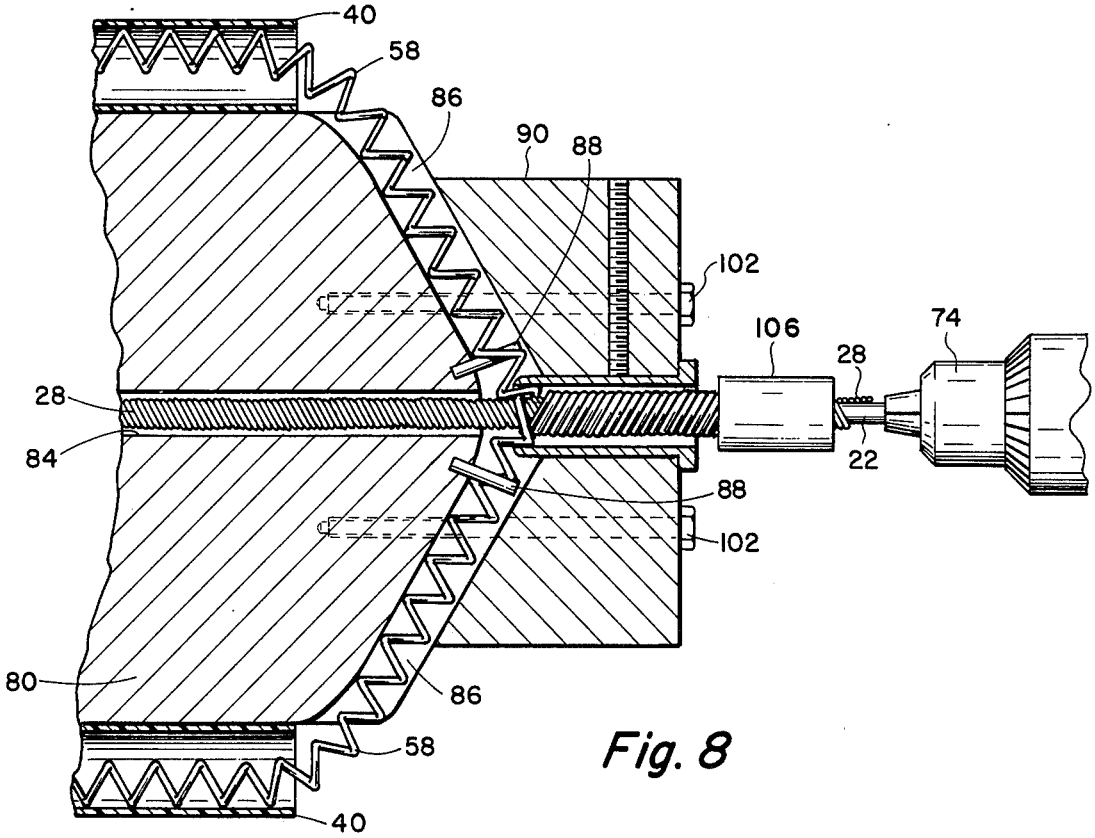
FIG. 8 is a sectional view of the wire feed head after the subsequent winding operation is begun and the cap is attached.
Figure 9:
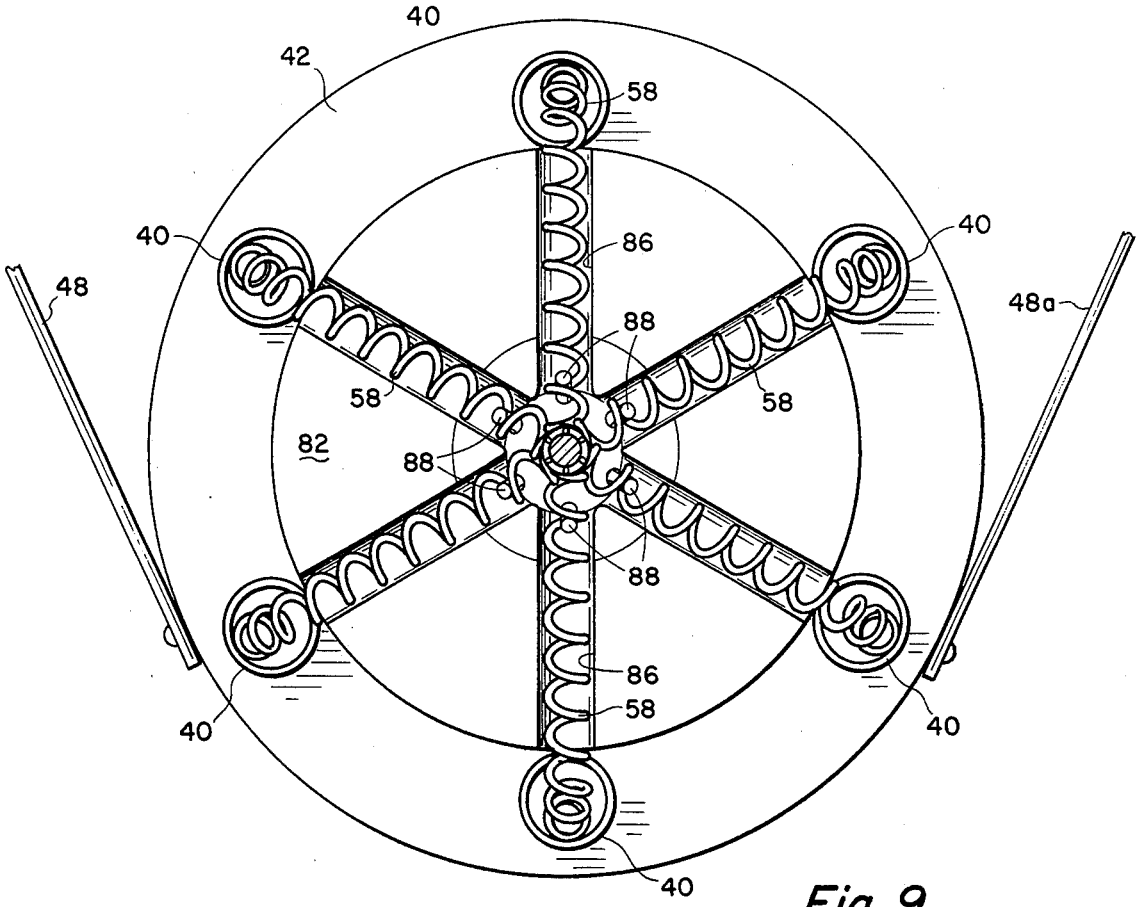
FIG. 9 is an end sectional view of the wire feed head as shown in FIG. 7.

Referring now to FIGS. 7, 8 and 9, the coil guide head 38 comprises a cylindrical body portion 80 having an outward face 82 which is in the shape of a conic frustum. The body 80 contains a centrally disposed bore 84 therethrough and is attached around the outer periphery thereof to one end of the plurality of tube members 40. The conic shaped face 82 of the guide head is provided with a plurality of radially extending, radially spaced passage ways or grooves 86, the outer ends thereof being in substantial alignment with the end of each tube member 40. The inner ends of the passage ways 86 terminate near the bore 84.

A plurality of longitudinally and outwardly extending guide pegs are secured to the face 82 of the guide head around the outer periphery of the bore 84, one such peg 88 being centrally disposed in alignment with the radial slots 86 of each passage way. The angle that the coil guide face 82 makes with the longitudinal axis of the bore 80 which is shown as angle "A" in FIG. 7 is designed to be substantially equal to the pitch angle of the coil 58 being used for the winding. Although this is not an essential limitation to the device, it has been found that the coils wind onto the mandrel 22 with more ease, if the angle of the face 82 meets this criteria.

The guide head 38 includes a cap member 90 which may be cylindrical in shape having a bore 92 therethrough, one end of the cap member 90 being provided with a conical recess 94 for receiving the conical shaped face 82 of the guide head therein. The cap in FIG. 7 is depicted with a bushing insert 96 which facilitates the moving of the wound mandrel therethrough. The cap 90 and guide head body 80 are provided with aligned threaded bores 98 and 100 repsectively for attachment of the cap to the guide head body 80 by a suitable bolt 102 as shown in FIG. 8.

Figure 6:
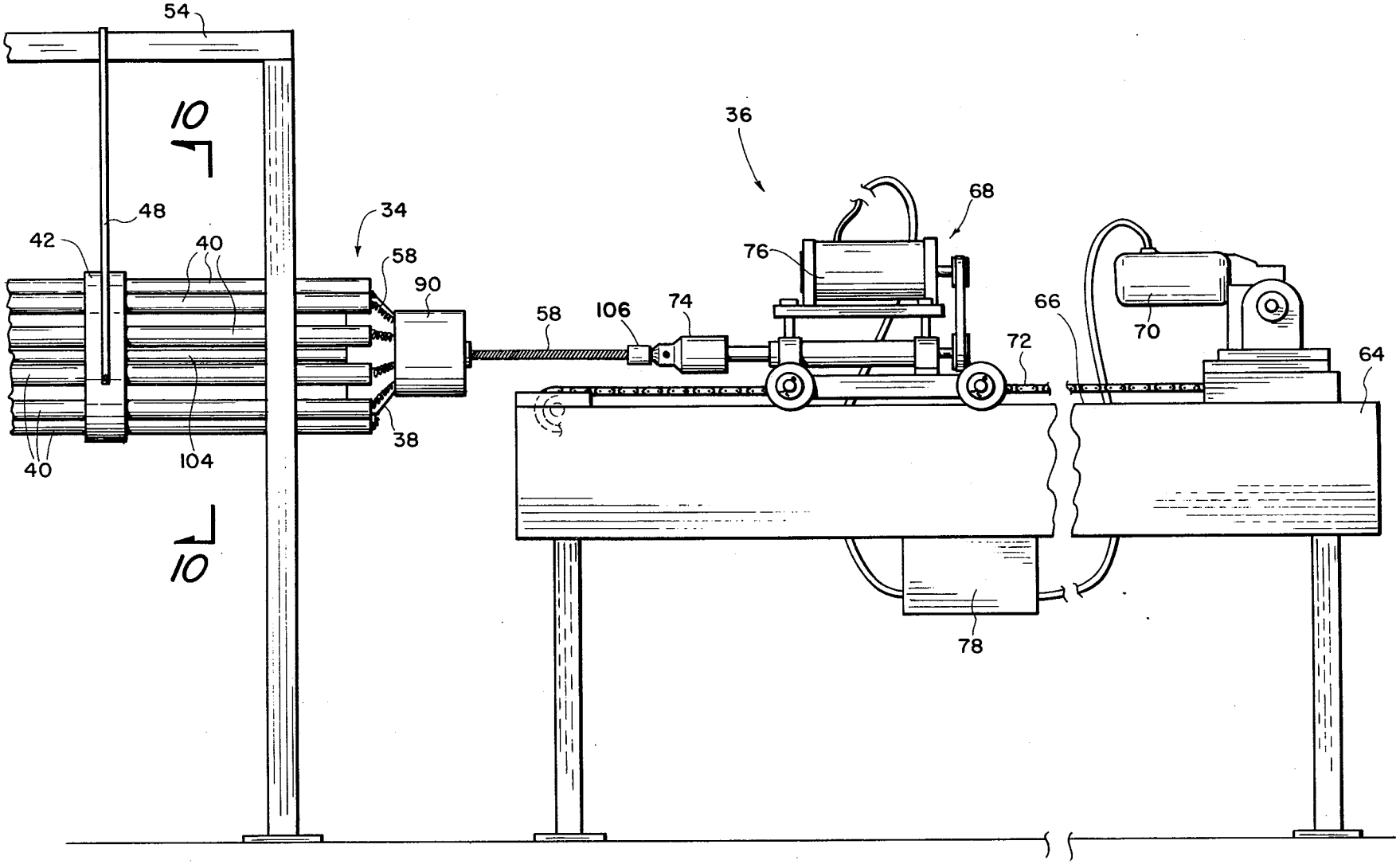
FIG. 6 is a detailed view of the winding apparatus of FIG. 4.
Figure 10:
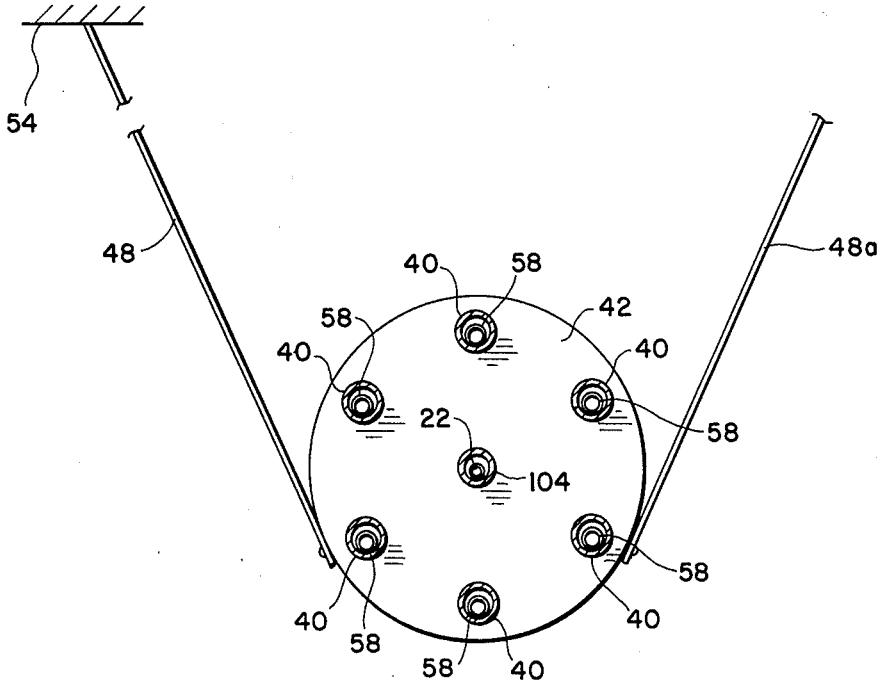
FIG. 10 is a sectional elevation view taken across broken lines 10—10 of FIG. 6 depicting alternate guide support means.

Referring now to FIG. 10 one of the separator discs 42 is depicted in an end view for supporting the tubes 40 in space relationship with respect to each other. As hereinbefore set forth, FIG. 10 is a sectional view taken along the broken lines 10-10 of FIG. 6 and further depicts centrally disposed tube 104 which extends rearwardly from the guide head 38 and is in substantial alignment with the bore 84 thereof. The tube 104 is primarily for the purpose of supporting the mandrel 22 that is to be wound. The hanger means 48, 50 and 52 as shown in FIG. 4 is shown in section at FIG. 10. The hanger means 48 comprises cables 48 and 48A for supporting the separator disc 42. The hangers 48 and 48A extend outwardly and upwardly to suitable attachment frame 54. This hanger support provides an automatic alignment feature, aligning the central bore 84 of the guide head with the chuck 74 of the winding apparatus in the following manner:

When the tube bundle is supported by a plurality of hangers 48, 50 and 52 in the manner shown in FIG. 4, and whereby these cables such as cables 48 and 48A extend upwardly and outwardly from the tube bundle, it is difficult for the tube bundle to swing transversely with respect to the frame member 54. Further, since the tube bundle is supported at three different locations it is difficult for it to rotate about a vertical axis which would throw it out of alignment with the chuck 74 of the winding apparatus. However, this hanger arrangement will allow tube bundle one degree of freedom of movement whereby it can move by pendulum action longitudinally with respect to the winding apparatus.

This suspension acts as both a shock absorber due to any drag that might occur while withdrawing the mandrel from the guide head and will also cause the entire bundle to swing in order to better align itself with the rotating chuck 74 of the trolley. Hence, it can be said that the bundle of tubes 40 are mounted by a pivotal means having one degree of rotational freedom, that degree of rotational freedom being about a horizontal axis transverse to the longitudinal axis of the tube member 40.

In operation, a first layer 28 of windings may be wound onto a mandrel 22 in accordance with the method and means hereinbefore described with respect to FIGS. 1 and 2 of the drawings. The wrapped mandrel is then inserted through the central tube 104 of the tube bundle 40 so that one end thereof extends through the guide head 38 as shown in FIG. 7. The ends of the wire coils 58 are then passed through the tubes 40 and into the passageways 86 thereof. Each coil 58 is then passed around its appropirate guide peg 84 as shown in FIG. 9 and manually wrapped around the outer layer 28 of cable as shown in FIG. 7 thereby forming a second layer 30. The guide head cap 90 is then put in place and the bolts 102 are installed. The cable ends are then clamped firmly in place to the mandrel by a suitable clamping means 106. At this point, the chuck 74 is attached to the end of the mandrel 22. Continued wrapping of the layer 30 is accomplished by rotating the mandrel 22 and simultaneously with the drawing head from the guide head longitudinally as shown in FIG. 8.

The rotational drive motor 76 of the trolley 68 and the drive motor 70 for longitudinal movement of the trolley 68 are then initiated by a suitable switch which is part of the synchronization means 78.

Upon initiation of the rotational and longitudinal trolley drive, the mandrel is rotated about its own axis and longitudinally moved out of the guide head 84 in a manner such that one rotation thereof occurs simultaneously as the rod is withdrawn by a distance equal to the pitch of the coils being wound thereon.

Each individual coil 58 is maintained in a correct rotational alingment with respect to its own axis by means of the peg members 88 which is most apparent in FIG. 9 of the drawings. The speeds of the drive motors 70 and 76 are not critical so long as their synchronization is maintained. After the winding operation is completed, a subsequent winding may be placed on the layer 30 by simply repeating the operation with a mechanism sized to the desired wrap diameter. Further, the winding of each successive layer of wire to form the cable should be in the opposite direction to that of the next previous layer as hereinbefore set forth.

It is further to be understood that each layer of the proposed cable may be wound on either the apparatus depicted in FIG. 4 or that depicted in FIG. 1 or any combination thereof. However, it is unknown by the inventors whether it is practical to wind subsequent layers by the apparatus of FIG. 1. After the winding operation is complete, the clamp 106 is removed and the mandrel 22 can be withdrawn therefrom. Normally the ends are fixed together by a tinning operation or other suitable means such as by a suitable fitting to hold the wires in place or a combination of those two operations.

Whereas, the foregoing invention has been described in particular relation to the drawings attached hereto, other and further modifications apart from those shown are suggested herein and may be made within the spirit and scope of the invention.

What is claimed:

1. A wire winding apparatus for wrapping an elongated rod with wire strands for forming flexible wire wound cable, said wire strands being in the form of individual helical coils, the apparatus comprising:

(a) coil guide means for radially guiding at least one helical coil inwardly toward a centrally disposed rod;

(b) coil guide support for supporting said coil guide means;

(c) first rod support carried by the coil guide support for longitudinally supporting said rod;

(d) winding means comprising a second rod support engageable with one end of the rod, said winding means capable of providing relative rotational and longitudinal movement between said rod and said coil guide means.

2. A wire winding apparatus as set forth in claim 1 wherein the coil guide means comprises a guide head having a centrally disposed bore therethrough for loosely supporting the longitudinal rod, radially extending passageways each for slidably receiving a helical coil therethrough.

3. A wire winding apparatus as set forth in claim 2 wherein said passageways form a conic frustum shape terminating adjacent the central bore therein.

4. A wire winding apparatus as set forth in claim 3 and including guide finger means in each said passageway adjacent to the central bore for radially orienting each of the coils with respect to the other coils to facilitate winding thereof.

5. A wire winding apparatus as set forth in claim 3 wherein the angle of each passageway with respect to the axis of the guide head central bore is substantially equal to the pitch angle of the coil therein.

6. A wire winding apparatus as set forth in claim 2 and including cover means attachable to the guide head for enclosing the passageways therein.

7. A wire winding apparatus as set forth in claim 2 including a plurality of radially spaced parallel coil guide tubes, each having one end thereof in open communication with the outer ends of each coil passageway.

8. A wire winding apparatus as set forth in claim 3 and including an elongated tube in coaxial alignment with the guide head central bore for supporting the elongated rod during the initial winding operation.

9. A wire winding apparatus as set forth in claim 1 wherein the second rod support means comprises rod end gripping means and wherein the wire winding means also comprises translating means for moving the rod gripping means and the associated rod supported thereby longitudinally with respect to the coil guide means, and rotation means for rotating the rod gripping means and associated rod supported thereby about its longitudinal axis simultaneously.

10. A wire winding apparatus as set forth in claim 9 wherein the wire winding means comprises synchronization means operably connected to the translating means and the rotating means for causing the rod and gripping means to travel a distance equal to the pitch of each coil during each rotation of the rotating means.

11. A wire winding apparatus as set forth in claim 9 wherein the rod and gripping means is an ordinary lathetype chuck.

12. A wire winding apparatus as set forth in claim 10 wherein the translating means comprises track means disposed parallel to the longitudinal axis of the coil guide central bore, troller means reciprocally disposed on said track means, said rod end gripping means carried by said trolley means and disposed in coaxial alignment with the coil guide central bore, drive means operably connected between the track means and the trolley means for translating the trolley means with respect to the track means.

13. A wire winding apparatus as set forth in claim 12 wherein the rotating means is carried by the trolley means and is operably connected to the rod end gripping means for rotating same.

14. A wire winding apparatus as set forth in claim 1 wherein said coil guide support means comprises longitudinal alignment means capable of maintaining longitudinal alignment of the coil guide means with the second rod support.

15. A wire winding apparatus as set forth in claim 14 wherein the alignment means comprises at least two elongated pendulum hangers operably connected between the coil guide support and the coil guide means and having only one degree of rotational freedom.

16. A process for manufacturing flexible wire wound cable utilizing wire in the form of preformed helical coil and a mandrel, the process comprising the following steps:

(a) wind a first layer of preformed first helical coil on the mandrel, said first preformed coil having its inside diameter substantially equal to the mandrel diameter;

(b) wind a second layer of second preformed helical coil over the first said layer, said second preformed helical coil having inside diameter substantially equal to the outside diameter of the first layer; and securing the layered coils together.

17. A process as set forth in claim 16 and including the additional step of removing the mandrel after the last layer of helical coil is wound for forming hollow wire wound cable.

18. A process as set forth in claim 16 and including the additional step of winding at least one subsequent layer of preformed helical coil comprising winding a subsequent layer of subsequent preformed helical coil on the next previous layer, and having inside diameter substantially equal to the outside diameter of said next previous layer.

19. A process as set forth in claim 18 and including a final step of removing the mandrel after the last layer of helical coil is wound for forming hollow wire wound cable.

20. A process of manufacturing flexible wire wound cables utilizing wire preformed into a helical coil configuration, the process comprising the steps of;

(a) wind a first layer of N preformed helical coils on the mandrel, each said helical coil having inside diameter Id and having wire diameters Wd, and having pitch P, said inside diameter Id being substantially equal to the diameter of the mandrel and wherein the pitch of each preformed helical coil is substantially equal to N times the helical coil wire diameter Wd.

21. A process as set forth in claim 20 and including the additional step of winding at least one subsequent layer of $N_i$ preformed helical coils, each of said subsequent helical coils having windings in the opposite direction from the next previous layer of helical coils, each said subsequent helical coil having inside diameter $Id_i$ substantially equal to the outside diameter of the next previous layer, and having wire diameter $Wd_i$ and having pitch $P_i$.

22. A process as set forth in claim 21 wherein $P_i$ is substantially equal to $N_i$ times $Wd_i$ and substantially equal to or greater than the inside diameter $Id_i$.

* * * * *